US007718937B1

(12) United States Patent
Dunn et al.

(10) Patent No.: US 7,718,937 B1
(45) **Date of Patent: *May 18, 2010**

(54) STEERING OF MISSILES

(75) Inventors: Albert Dunn, Bangor (GB); Richard Sutton Ransom, Holywood (GB)

(73) Assignee: Short Brothers PLC, Belfast (GB)

( * ) Notice: Subject to any disclaimer, the term of this patent is extended or adjusted under 35 U.S.C. 154(b) by 0 days.

This patent is subject to a terminal disclaimer.

(21) Appl. No.: 06/531,939

(22) Filed: Sep. 7, 1983

(51) Int. Cl.
*F42B 10/02* (2006.01)
*F41G 7/00* (2006.01)
*F42B 15/00* (2006.01)

(52) U.S. Cl. ..... 244/3.23; 244/3.11; 244/3.13; 244/3.15; 244/3.21

(58) Field of Classification Search ..... 244/3.1–3.3
See application file for complete search history.

(56) References Cited

U.S. PATENT DOCUMENTS 3,111,088 A * 11/1963 Fisk ..... 244/3.23
3,957,377 A 5/1976 Hutchinson ..... 356/152
4,014,482 A * 3/1977 Esker et al. ..... 244/3.13
4,076,187 A * 2/1978 Metz ..... 244/3.23

FOREIGN PATENT DOCUMENTS

GB 1547882 6/1979

* cited by examiner

*Primary Examiner*—Bernarr E Gregory
(74) *Attorney, Agent, or Firm*—Venable LLP; Jeffri A. Kaminski; Justine A. Gozzi

(57) ABSTRACT

A beam-riding missile (10) has a freely rotating control portion (11) forming its nose and carrying a pair of fixed ailerons (13) and a pair of fixed elevators (14). Detecting means (not shown) gather information indicative of the location of the missile in the beam and steering logic circuitry (not shown) provides signals to a clutch (18) which interfers with the free rotation of the nose in such a way that the elevators are effective to maintain the chosen flight path.

The clutch can be electromagnetic, piezo-electric or function on the Johnson-Raebeck effect.

The combination of fixed control surfaces and steering by a single actuator leads to the possibility of useful reductions in the size, weight and complexity of the missile.

10 Claims, 4 Drawing Sheets

STEERING OF MISSILES

FIELD OF THE INVENTION

This invention relates to the steering of missiles. It is particularly, but not exclusively, concerned with small, aerial missiles having an elongate body with main, fixed flight surfaces which cause the body to rotate in one direction during flight of the missile, and a relatively small nose portion which tends to rotate in the opposite direction during the flight of the missile.

SUMMARY OF THE INVENTION

According to the present invention there is provided a missile suitable for controlled flight through a fluid medium having an elongate body portion of relatively high inertia and a control portion of relatively low inertia which can rotate freely on the body portion about the longitudinal axis of the missile, wherein:

(1) the control portion has an aileron which is fixed at a predetermined and constant angle of incidence so that, in flight of the missile, the force of reaction between the aileron and the fluid medium gives to the control portion a tendency to rotate within the fluid medium, (2) the body portion is provided with control means which induce in the body portion a rate of change of roll angle of the body portion relative to the fluid medium which is different from that of the control portion, (3) the control portion includes an elevator which is fixed at a predetermined and constant angle of incidence to react at all times during the flight of the missile against the fluid medium incident upon it to impose an instantaneous lateral force on the missile, and the missile includes (1) detecting means for generating an error signal indicative of a discrepancy between an instantaneous flight path of the missile and a chosen flight path, and (2) steering means comprising steering logic responsive to said error signal for generating a missile steering signal and a clutch responsive to the steering signal for limiting the free rotation between the body portion and the control portion of the missile such that, in response to the error signal, the steering means biases the control portion towards that roll angle at which the transverse force imposed on the missile by the elevator is such as to reduce said discrepancy.

In the miniature missiles for which the present invention has particular application, it may be convenient for the control portion to be embodied as a relatively small nose section of the missile, which nose may essentially comprise a pair of fixed ailerons at opposite ends of a first transverse diameter, a pair of fixed elevators at opposite ends of a second transverse diameter, itself transverse to the first and a mass of dense metallic material as a charge to be delivered to the target by the missile.

The body of the missile, on the other hand, may contain one or more gyroscopes for maintaining the missile stable and possibly assisting in its guidance. One convenient way of defining the chosen flight path is to provide a beam, such as a laser beam, emanating from a missile guidance station. Although a laser is preferred, other coherent, electromagnetic radiation may be suitable for the beam. Sensors on a rearward-facing surface of the missile feed sufficient information about the position of the missile within the beam to steer the missile and keep it within the beam.

Missiles according to the invention may be employed as sub-missiles in the invention disclosed in our co-pending British Patent Application No. 8132088, in which Application the small size which can be achieved in the missiles of the present invention is of prime importance.

For a better understanding of the invention, and to show more clearly how the same may be carried into effect, reference will now be made to the accompanying drawings in which:

DESCRIPTION OF THE PREFERRED EMBODIMENT

Figure 1:
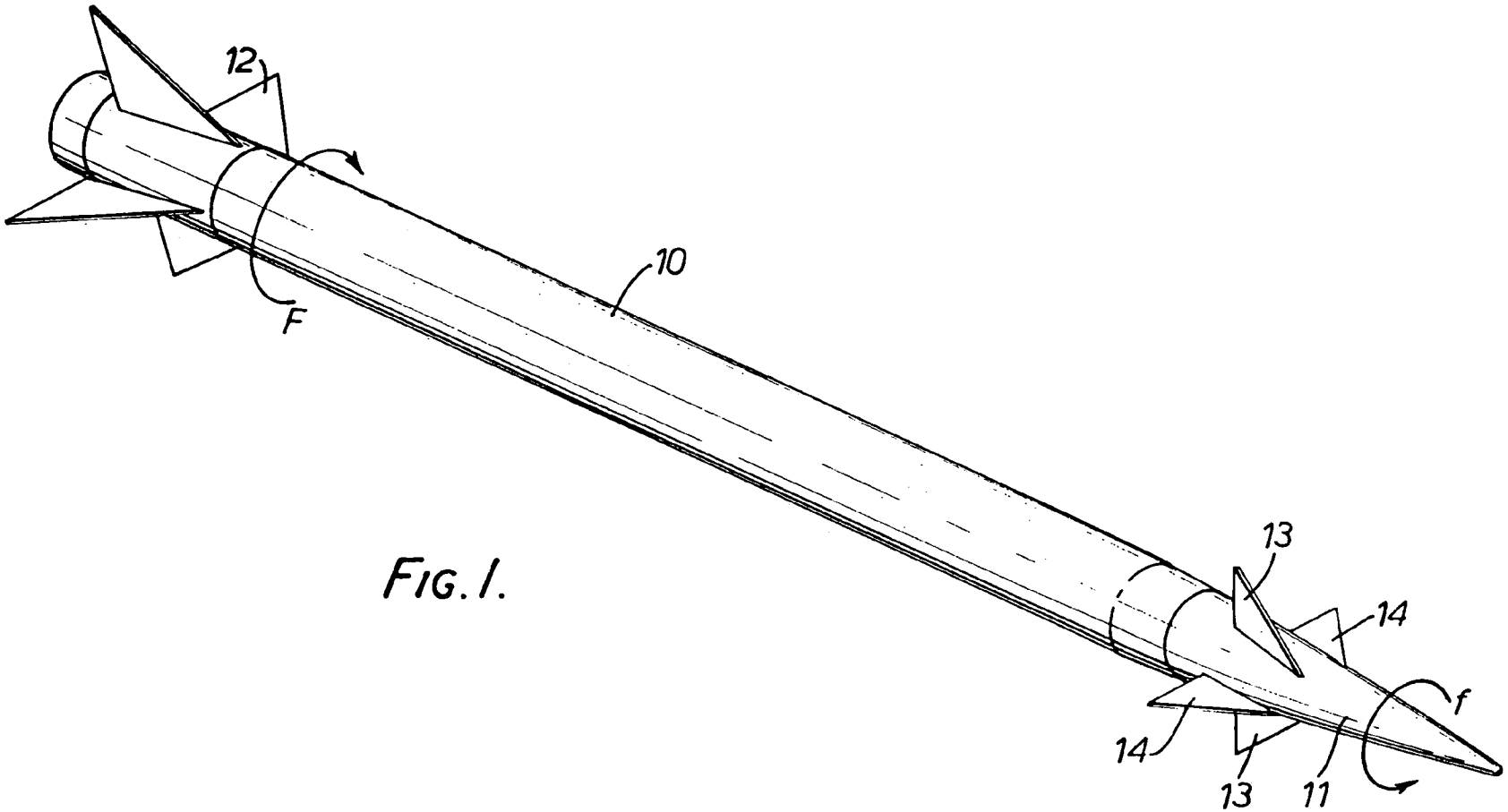
FIG. 1 is a perspective view of a missile according to the invention.

FIG. 1 shows a missile having a body 10 and a nose section 11. Four main flight surfaces 12 are provided at the rear of the body 10 and are so oriented that the body 10 has a tendency to rotate in a clockwise direction (viewed from the front of the missile) during normal flight, as indicated by arrow F.

A nose section 11 of the missile is freely rotatable relative to the body portion 10 about the longitudinal axis of the missile. It carries a pair 13 of fixed ailerons at opposite ends of a transverse diameter of the nose, these giving the nose 11 a tendency to rotate in normal flight of the missile in a direction shown by arrow f counter to that of the body portion 10 in normal flight of the missile. A pair of elevators 14 fixed on the nose section at a small angle of incidence and located at opposite ends of a diameter transverse to that containing the ailerons 13 imposes on the missile a transverse force i.e. one in directions transverse to that of its flight. During such time as the rotation of the nose 11 is free there is no resultant unidirectional transverse steering force on the missile. However, when the free rotation is interrupted, the resultant force will accelerate the missile in a direction transverse to its length.

It will be appreciated from the foregoing that flight of the missile is controlled in canard fashion.

Figure 2:
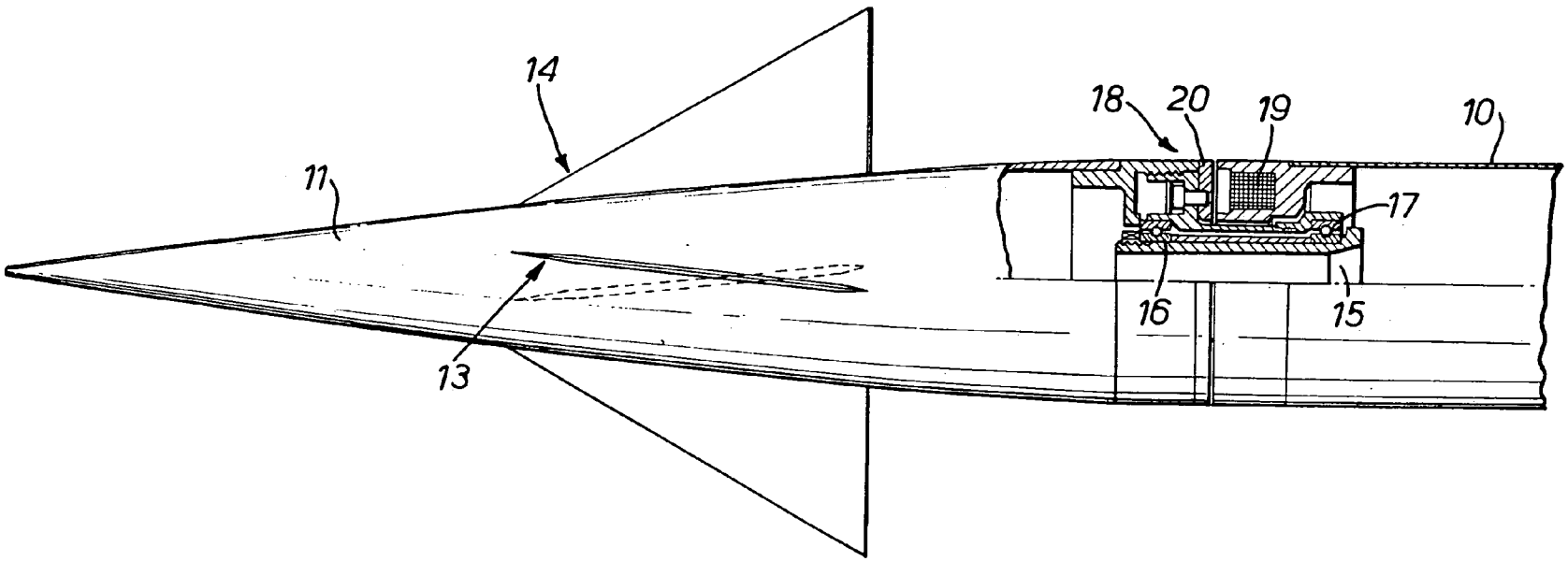
FIG. 2 is a view from one side of a forward part of the missile of FIG. 1, partly cut away to reveal details of a slip clutch.

FIG. 2 shows in somewhat more detail the connection of the nose 11 and the body 10. An axial shaft 15 of the nose extends rearwardly into the body 10 and is carried therein by a forward ball race 16 and a rearward ball race 17. A conventional electromagnetic clutch, referenced generally 18, is employed to interfere with free rotation of the nose 11 relative to the body 10 in a manner known per se. The clutch 18 comprises an annular coil 19 through which an electric current may be flowed to generate an electromagnetic field which interacts with an armature 20 on the nose 13 to resist rotation of the nose 13 relative to the coil 19. Electrical current is supplied to the coil 19 by a steering means, not shown in FIG. 2, which varies this current with time in such a way as to interfere with the free rotation of the nose at times when a steering correction of the missile is required. This interference introduces a disparity between the length of time which the elevator surfaces 14 occupy in one angular position of the nose and the time during which they occupy other angular positions i.e. it biases the elevators towards a selected angular position thereby to accelerate the missile transversely as necessary to correct the path of its flight. In the limiting case, the current through the coil is such as to maintain the angular position of the nose fixed in relation to the environment of the missile for long enough to achieve the necessary steering connection.

The missile illustrated in FIGS. 1 and 2 is guided along a plane polarised, pulsed laser beams emanating from a missile control station. The length of each of the laser pulses is conveniently 100 ns. On a rearward-facing surface of the missile are provided pin photodiodes having crossed polarising filters. These photodiodes respond to the laser beam and produce electrical signals used in steering the missile, as shown schematically in FIGS. 3*a* and 3*b*.

Figure 3A:
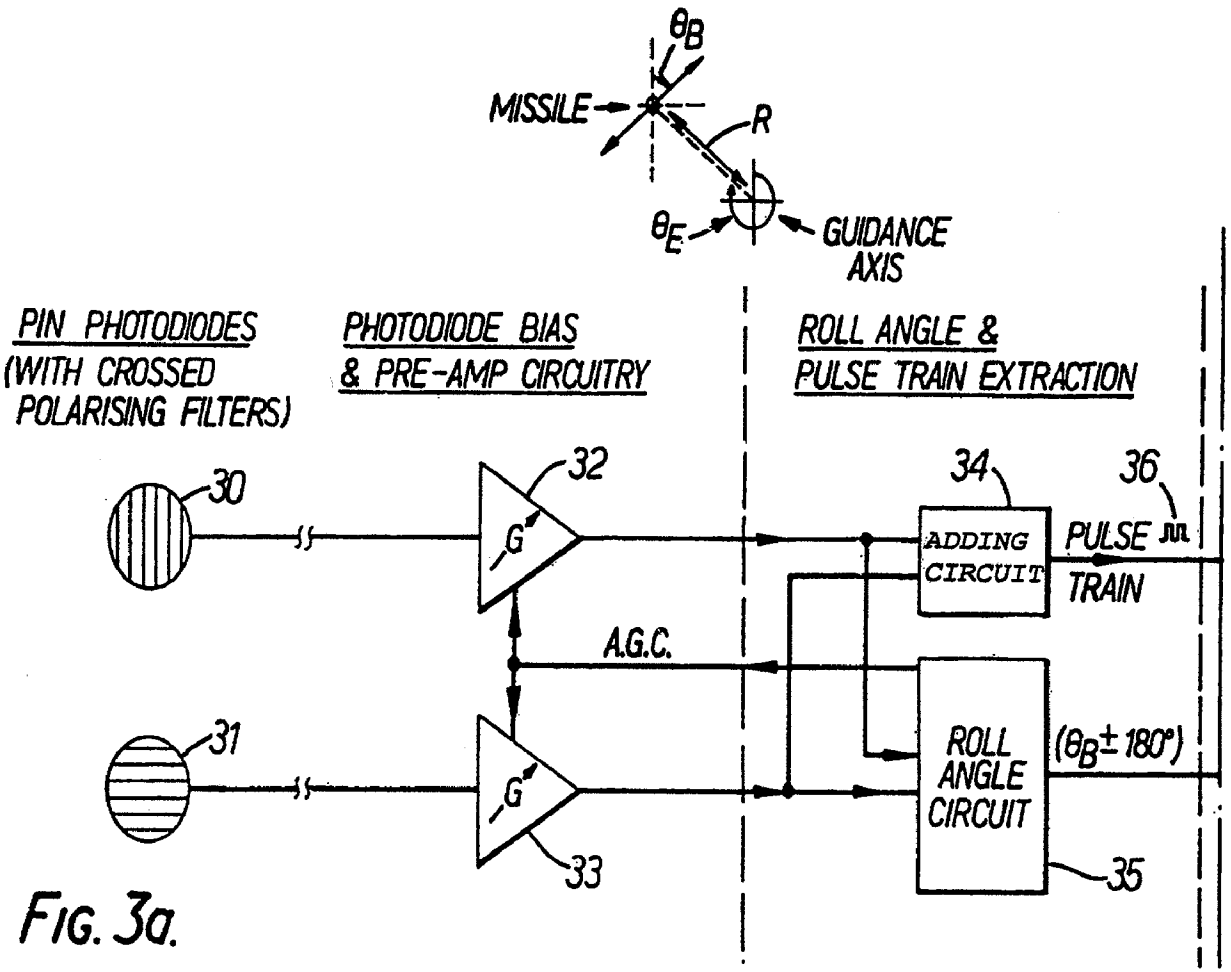
FIGS. 3*a* and 3*b* are a block diagram of the steering means which controls the slip clutch.
Figure 3B:
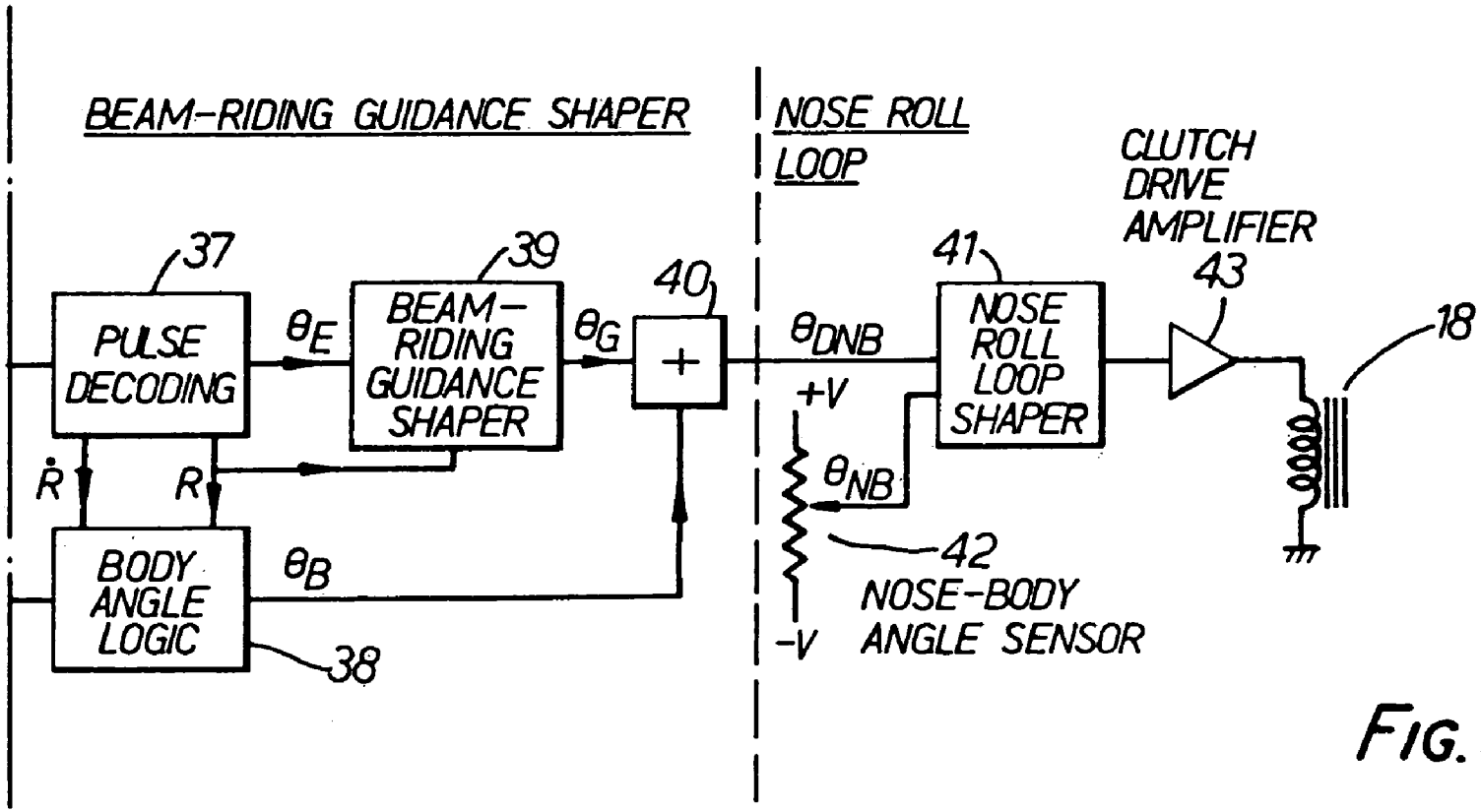

In FIG. 3*a*, a first photodiode 30 and second photodiode 31, each having a sensitive area of 5½ mm diameter, generate electrical signals when the laser beam is incident upon them, these signals constituting inputs to the remaining components of the steering means of the missile. The transmittance of the polarisers when crossed with the laser beam is 3% and when parallel is 45%. The output current from each photodiode is proportional to $\cos^2\theta$ (where $\theta$ is the angle between the plane of polarisation of the laser beam and that of the polariser on the photodiode). The responsivity of each photodiode cell is 0.5 A/W, the maximum output is $3\times10^{-4}$ A and the minimum is $5\times10^{-8}$ A. When $\theta=45°$ for each of the two polarisers, the transmittance of each is the same, at 25%.

The laser beam is modulated in such a way that the inputs vary according to the position of the diodes 30 and 31 within the laser beam. More particularly, the signals from the photodiodes carry information sufficient to establish a radial discrepancy R of the longitudinal axis of the missile from a notional guidance axis at the centre of the laser beam and an error angle $\theta_E$ representative of the direction in which the axis of the missile lies relative to the notional guidance axis.

An analogous arrangement is shown in U.S. Pat. No. 3,957,377.

As shown in FIG. 3*a*, the photodiodes 30 and 31 have crossed polarising filters and so, as shown in the drawing, with a polarised laser beam, a comparison of the signals emanating from the photodiodes establishes a roll angle $\theta_B$ of the missile body 10 relative to the plane of polarisation of the laser beam.

The diodes 30 and 31 provide inputs to amplifiers 32 and 33 respectively, these constituting photodiode bias and pre-amp circuitry which typically has a complexity in a range of from 2 to 4 op-amps. The analogue outputs from the amplifiers 32 and 33 provide two inputs to each of an adding circuit 34 and a roll angle circuit 35, these two circuits together performing a function of missile roll angle and pulse train extraction and typically having a complexity of 2 op-amps.

The adding circuit 34 provides as a digital output a series of pulse trains 36 which series is representative of the pulsed laser guidance beam received by the diodes 30 and 31. The laser beam is so modulated that the duration of the pulses 36 which the adding circuit 34 produces as its output is representative of the said radial error R. The frequency of repetition of the pulses 36 is representative of the error angle $\theta_E$.

The pulses 36 are fed to a pulse decoding circuit 37. The output from the roll angle circuit 35 provides information as to the roll angle $\theta_B$ of the missile body relative to space. It does not identify a unique roll angle but rather one of two roll angles spaced apart by 180°. The output of the roll angle circuit 35 is fed to a body angle logic circuit 38. The roll angle circuit 35 also generates an automatic gain control (AGC) signal which is fed to the amplifiers 32 and 33 where it serves to ensure their linear operation. So long as the amplification is linear, the body roll angle $\theta_B$ is determinable by comparison of the magnitude of the outputs of the amplifiers 32 and 33.

The circuits 37 and 38 are components of digital logic, beam-riding guidance circuitry, (typically of complexity 4 op-amps), which examines the error angle $\theta_E$ and determines what angle $\theta_G$ of the nose section 11 of the missile in space is needed to rectify the error. The desired space angle of the nose section 11 is achieved by securing a desired angle of the nose section 11 $\theta_{DNB}$ relative to the body of the missile 11 having regard to the space roll angle $\theta_B$ of the missile body.

Thus, the guidance circuitry comprises beam-riding guidance shaper circuitry 39 which receives from the pulse decoding circuit 37 an input signal indicative of the missile body error angle $\theta_E$ and the radial error R. From these inputs it determines what is the required missile nose space angle $\theta_G$ and provides this as input to an adding circuit 40.

The body angle logic circuit 38 examines how the instantaneous radial error R and the rate of changes, $\dot{R}$, in R vary in consequence of a guidance command and, from this information, inverts the signal from the roll angle circuit 35 when necessary, to provide an unambiguous missile body space roll angle $\theta_B$ as input to the adding circuit 40. This last circuit provides, as an analogue output from the guidance circuitry, a signal representative of a demanded relative angle $\theta_{DNB}$ between the body of the missile and the nose of the missile.

This output is fed to analogue nose roll loop circuitry comprising a shaper circuit 41 (which is typically of 3 op-amps complexity) which compares the demanded angle with a signal derived from a voltage divider 42 which is representative of the actual angle $\theta_{NB}$ between the nose and the body of the missile. At such times when the longitudinal axis of the missile is coincident with the notional guidance axis there will be zero output from the guidance shaper circuit 39 so that the adding circuit 40 will merely feed to the nose roll loop shaper 41 a cyclical signal indicative of $\theta_B$, i.e. the steady rotation in space of the missile body 10. In these circumstances the circuit 41 produces zero output.

On the other hand, whenever there is a radial discrepancy R between the axis of the missile body 10 and the notional guidance axis, the adding circuit 40 will produce a signal which causes the circuit 41 to produce an output amplified by a drive amplifier 43 for operating the clutch 18 between the missile body 10 and the nose 11 to procure a demanded nose body angle $\theta_{DNB}$.

The clutch need not be an electromagnetic device such as is shown in the illustrated embodiment. It can be, for example a piezo-electric device which responds to the passage of electric current therethrough to expand along one axis and thereby exert a frictional resistance to the free rotation of the nose portion on the body of the missile. Again, a clutch member may utilise the Johnson-Raebeck effect whereby a material such as agate undergoes a change in its coefficient of friction when it is subject to electrical stress. A suitable device for use as the clutch 18 which utilises this effect is made by M.L. Aviation Limited, whose address is White Waltham Aerodrome, Maidenhead, Berkshire.

Information about the roll angle of the missile body in space can be obtained from a roll gyroscope on board the missile instead of from a laser beam guidance signal.

The invention claimed is:

1. A missile suitable for controlled flight through a fluid medium having an elongate body portion of relatively high inertia and a control portion of relatively low inertia which can rotate freely on the body portion about the longitudinal axis of the missile, wherein:

(1) the control portion has an aileron which is fixed at a predetermined and constant angle of incidence so that, in flight of the missile, the force of reaction between the aileron and the fluid medium gives to the control portion a tendency to rotate within the fluid medium, (2) the body portion is provided with control means which induce in the body portion a rate of change of roll angle of the body portion relative to the fluid medium which is different from that of the control portion, (3) the control portion includes an elevator which is fixed at a predetermined and constant angle of incidence to react at all times during the flight of the missile against the fluid medium incident upon it to impose an instantaneous lateral force on the missile, and the missile includes (1) detecting means for generating an error signal indicative of a discrepancy between an instantaneous flight path of the missile and a chosen flight path, and (2) steering means comprising steering logic responsive to said error signal for generating a missile steering signal and a clutch responsive to the steering signal for limiting the free rotation between the body portion and the control portion of the missile such that, in response to the error signal, the steering means biases the control portion towards that roll angle at which the transverse force imposed on the missile by the elevator is such as to reduce said discrepancy.

2. A missile as claimed in claim 1, wherein the control portion is provided as a nose section of the missile.

3. A missile as claimed in claim 1, wherein the aileron is provided as a pair of fixed ailerons at opposite ends of a first transverse diameter.

4. A missile as claimed in claim 3, wherein the elevator is provided as a pair of fixed elevators at opposite ends of a second transverse diameter, itself transverse to the said second diameter.

5. A missile as claimed in claim 1, including detecting means to gather information from a radiation beam defining a flight path for the missile.

6. A missile as claimed in claim 5, wherein the radiation of the beam is electromagnetic, and coherent.

7. A missile as claimed in claim 6, wherein the detecting means is sensitive to laser radiation.

8. A missile as claimed in claim 7, wherein the detecting means comprises two crossed, plane polarising elements each covering a photodiode element.

9. A missile as claimed in claim 5, wherein the beam is modulated in such a way that the information gathered by the said detecting means is sufficient to determine the radial and angular displacement of the missile from a reference axis along the beam.

10. A missile as claimed in claim 1, wherein the said clutch is an electromagnetic clutch.

* * * * *